US008523438B2

(12) United States Patent
Roger

(10) Patent No.: US 8,523,438 B2
(45) Date of Patent: Sep. 3, 2013

(54) DEVICE INTENDED FOR THE CLOSURE OF BAGS WHICH INCLUDES RESOURCES THAT RESIST THE PULLING-OFF OF A SLIDER, AND BAG THAT IS SO EQUIPPED

(75) Inventor: Antony Roger, Sartrouville (FR)

(73) Assignee: S2F Flexico, Henonville (FR)

( * ) Notice: Subject to any disclaimer, the term of this patent is extended or adjusted under 35 U.S.C. 154(b) by 17 days.

(21) Appl. No.: 11/399,751

(22) Filed: Apr. 7, 2006

(65) Prior Publication Data

US 2006/0225256 A1 Oct. 12, 2006

(30) Foreign Application Priority Data

Apr. 8, 2005 (FR) ..... 05 03517

(51) Int. Cl.
*B65D 33/16* (2006.01)
*A44B 1/04* (2006.01)
*A44B 19/00* (2006.01)

(52) U.S. Cl.
USPC ..... 383/64; 24/399; 24/585.12

(58) Field of Classification Search
USPC ..... 24/399, 400, 30.5, 585.12; 383/63, 383/64, 59
See application file for complete search history.

(56) References Cited

U.S. PATENT DOCUMENTS 3,115,689 A * 12/1963 Jacobs ..... 24/399
3,122,807 A * 3/1964 Ausnit ..... 24/399
3,230,593 A * 1/1966 Herz ..... 24/399
3,426,396 A * 2/1969 Laguerre ..... 24/399
5,664,299 A * 9/1997 Porchia et al. ..... 24/400
5,836,056 A * 11/1998 Porchia et al. ..... 24/400
5,983,466 A * 11/1999 Petkovsek ..... 24/400
6,461,042 B1 * 10/2002 Tomic et al. ..... 383/64
6,915,546 B2 * 7/2005 Kasai ..... 24/30.5 R
6,948,848 B2 * 9/2005 Ausnit ..... 383/64
7,165,292 B2 * 1/2007 Kasai ..... 24/30.5 R
7,416,338 B2 * 8/2008 Ausnit ..... 383/64
2002/0064322 A1 5/2002 May
2003/0235351 A1 * 12/2003 Plourde ..... 383/64
2004/0190798 A1 * 9/2004 Ausnit ..... 383/64
2005/0281491 A1 * 12/2005 Ausnit ..... 383/64

FOREIGN PATENT DOCUMENTS

EP 1 247 748 A1 10/2002
WO WO 92/17085 10/1992

* cited by examiner

*Primary Examiner* — Jes F Pascua

(74) *Attorney, Agent, or Firm* — Blakely Sokoloff Taylor & Zafman

(57) ABSTRACT

This present invention concerns a closure assembly that has two complementary elements which are capable of being successively joined and separated, and a slider that includes a base, two lateral walls, a low central ridge and a soleplate connected to the low central ridge, characterized by the fact that at least one of the two elements has, on its inside surface, a structure that is capable of being pressed against the soleplate under the effect of a pulling force so that, under the effect of this force, the said element tends to be flattened against the associated lateral wall of the sider.

15 Claims, 3 Drawing Sheets

DEVICE INTENDED FOR THE CLOSURE OF BAGS WHICH INCLUDES RESOURCES THAT RESIST THE PULLING-OFF OF A SLIDER, AND BAG THAT IS SO EQUIPPED

BACKGROUND OF THE INVENTION

1. Field of the Invention

This present invention concerns the area of bags that include closure devices operated by a slider.

Many devices of this type have already been proposed.

The bag closure devices generally include two zipper elements of the complementary male/female type or of the complementary hook type, designed to allow multiple successive openings and closures.

The slider has as its objective to facilitate the joining and the separation of the zippers respectively.

2. Description of Related Art

The attached FIGS. 1 to 5 show a slider-type closure device according to existing designs.

As can be seen in-these figures, the slider 100 generally includes a base 110 which carries two lateral walls 120, 130 and a low central ridge 140. The walls 120, 130 and the low ridge 140 combine to form two channels 150, 160 which are not parallel at least in part. These channels receive elements that are connected respectively to two zipper mouldings 200, 250.

The known sliders have already given great service. They facilitate the opening and the closure of the bags, since it suffices to move the slider, and according to the direction of motion of the latter, to separate or join the zippers because of the non-parallel nature of the channels 150, 160.

However the bags thus equipped has a serious drawback, in that the sliders are sometimes observed to pull apart, and in particular there is a risk of ingestion by children.

In an attempt to reduce this risk, people have already proposed, as illustrated in the appended figures, the addition to the free edged of the walls 120, 130 of the longitudinal ribs 122, 132 designed to take up position under the zippers. However this measure proved to be insufficient. In the event of a large force being applied to the slider, the walls 120, 130 are separated and the slider pulled off.

As illustrated in FIGS. 3, 4 and 5, there have also been proposals to place a soleplate 142 on the end of the low central ridge 140. The soleplate 142 is intended to take up position under the zippers 200, 250 as can be seen in FIGS. 4 and 5. However here again, this solution does not give total satisfaction. In fact, the soleplate 142 must have a shape which is tapered in the direction of the convergence of the channels 150, 160 in order not to interfere with the closure of the bag. In practice therefore, one observes that the risk of pulling-off of the slider still remains, in particular by pivoting and extraction by the tapered end of the soleplate which acts in the manner of a wedge forcing the zippers apart.

Document U.S. Pat. No. 5,664,299 proposed another solution, illustrated in FIG. 6 attached, which consists of adding to the outer face of the backing-strips 202, 252 bearing the complementary closure zippers 200, 250, ribs 204, 254 which are designed to press against the longitudinal ribs 122, 132 of the slider. However this solution also fails to give total satisfaction. It turns out in fact that if a pulling force is applied to the slider, ribs 204, and 254 tend to slide on ribs 122 and 132, and this tends to draw the two closure elements together, and to guide them toward the free passage between ribs 122 and 132, contrary to the initial objective of locking and retention.

Another solution was proposed in document FR-A-2855 153. This solution is illustrated in FIG. 7. It consist of providing, on at least one of the closure elements, a structure 210, 260 that is concave toward the interior of the bag, forming an end-stop for the soleplate 242 in order to prevent the withdrawal of the slider 100 under the effect of a pulling force.

BRIEF SUMMARY OF THE INVENTION

This present invention has as its objective to perfect the known devices by limiting the risk of slider pull-off.

This objective is attained in the context of this present invention by virtue of a closure assembly that includes two complementary elements which are suitable to be successively joined and separated, and a slider that includes a base, two lateral walls, a low central ridge and a soleplate connected to the low central ridge, characterised by the fact that at least one of the two elements has, on its inside surface, a structure that is able to press against the soleplate under the effect of a pulling force so that, under the effect of this force, the said element tends to be flattened against the associated lateral wall of the slider.

As will be explained in what follows, in contrast to document U.S. Pat. No. 5,664,299, the structure thus proposed in the context of this present invention leads to a strengthening of the contact, and therefore an increase in the friction, between the lateral walls of the slider and the closure assembly, in the event of applying a pulling force.

This present invention also concerns bags that are equipped with such a closure assembly.

BRIEF DESCRIPTION OF THE DRAWINGS

Other characteristics, objectives and advantages of this present invention will appear on reading the detailed description that follows, with reference to the appended drawings, provided by way of non-limiting examples and in which.

DETAILED DESCRIPTION OF THE INVENTION

Figure 1:
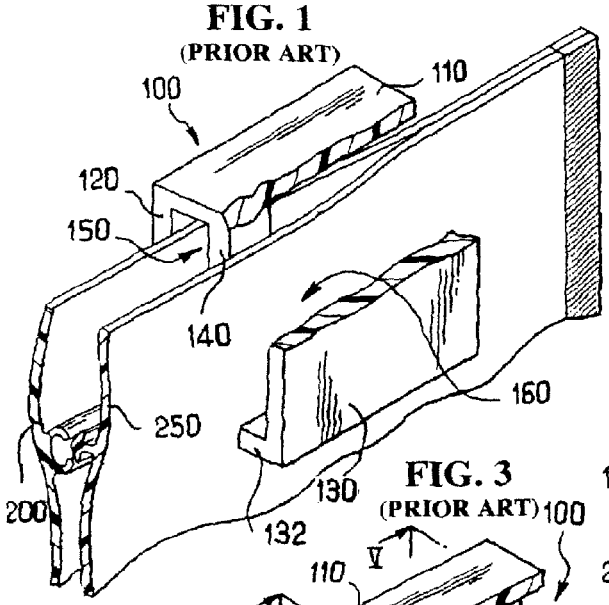
FIG. 1 (PRIOR ART)
FIG. 1, described above, shows a diagrammatic view in perspective, partially exploded, of a known closure assembly according to existing designs, FIG. 2, described above, is a view in cross-section of the closure assembly of FIG. 1.
Figure 2:
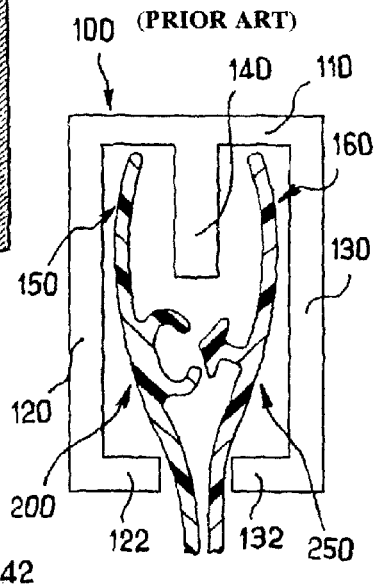
FIG. 2 (PRIOR ART)
Figure 3:
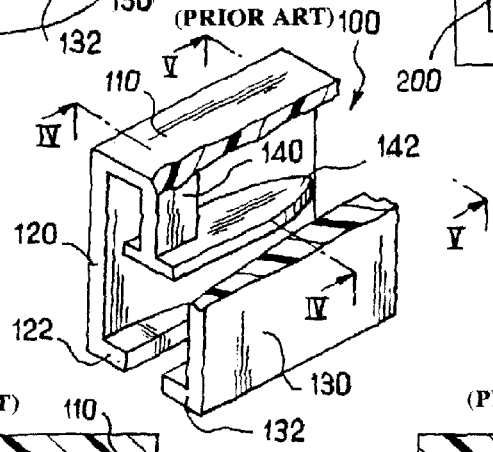
FIG. 3 (PRIOR ART)
FIG. 3 described above, shows a view in perspective, partially exploded, of a slider according to existing designs, FIGS. 4 and 5, described previously, represent two views in cross section of a closure assembly fitted with such a slider in two planes referenced IV-IV and V-V in FIG. 3, FIG. 6, described above, shows a closure assembly according to the text of document U.S. Pat. No. 5,664,299, FIG. 7, described above, shows a closure assembly according to the text of document FR-A-2 855 153.
Figure 4:
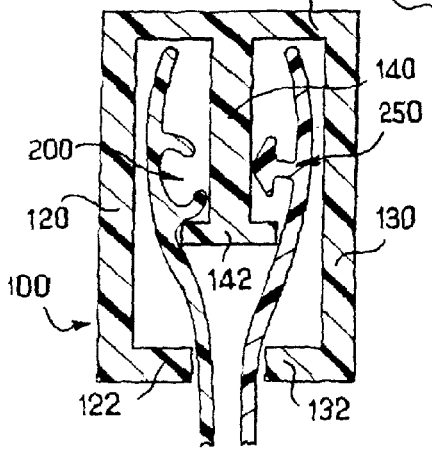
FIG. 4 (PRIOR ART)
Figure 5:
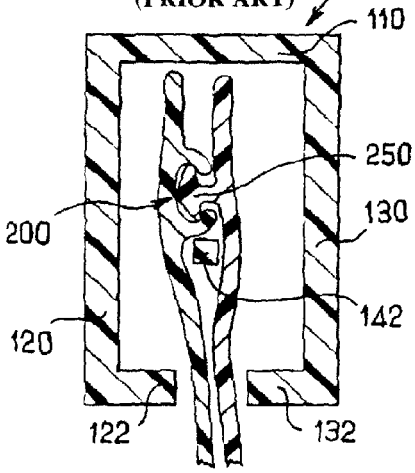
FIG. 5 (PRIOR ART)
Figure 6:
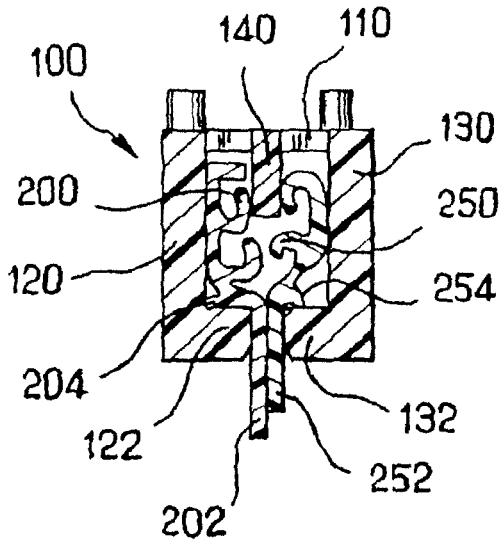
FIG. 6 (PRIOR ART)
Figure 7:
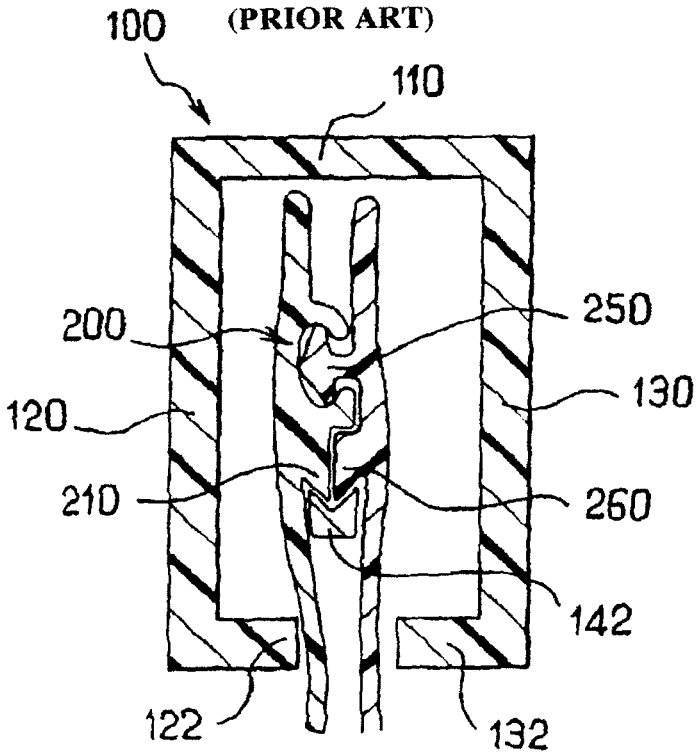
FIG. 7 (PRIOR ART)

This present invention can find its application in all types of bag. For this reason, we will not describe in detail, in what follows, the resources for the creation of the bag itself or its components or its materials.

This also applies to the closure zippers 200, 250. They are not limited to the geometry shown in the appended figures. These zippers can be of the complementary male/female type, of the complementary hook type, of the complementary velcro type, or any other equivalent structure. They can be made from any appropriate material. The closure zippers 200, 250 can be moulded from material with the ridges of the bag, created by extrusion for example or assembled to and secured on the ridges of the bag by any appropriate means.

Likewise, the general structure of the slider 100 and its component material will not be described in detail in what follows. We will concentrate on describing the essential characteristic of the invention.

The slider 100 can be made from metal or a plastic material. It includes a base 110, two lateral walls 120, 130 and a low central ridge 140 which carries a soleplate 142. The lateral walls 120, 130 and the low central ridge 140 combine to form two channels 150, 160 which are not parallel, at least in part.

As indicated previously, according to the invention, at least one of the two complementary elements 200, 250 of the closure assembly has a structure 300 which is designed to press against the soleplate 142 when a pulling force is applied to the slider 100. According to the representation given in FIGS. 8 and 9, only element 250 is fitted with such a structure 300.

Preferably, in the context of the invention, this structure 300 is formed from a rib that is adjacent to the soleplate 142 and attached to the internal face 252 of the backing-strip 254 which bears the closure element 250.

Figure 8:
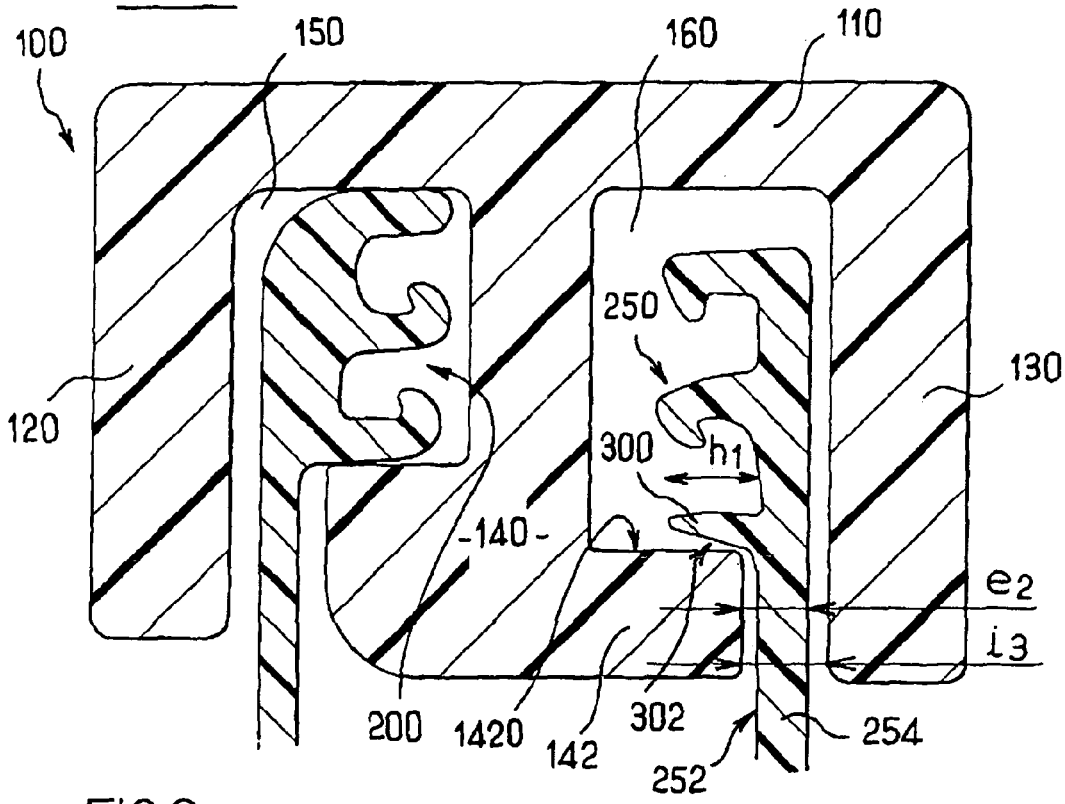
FIG. 8 is a view in cross-section of a slider and of closure zippers according to this present invention, and FIG. 9 shown a similar view of the same resources when subjected to a pulling force.
Figure 9:
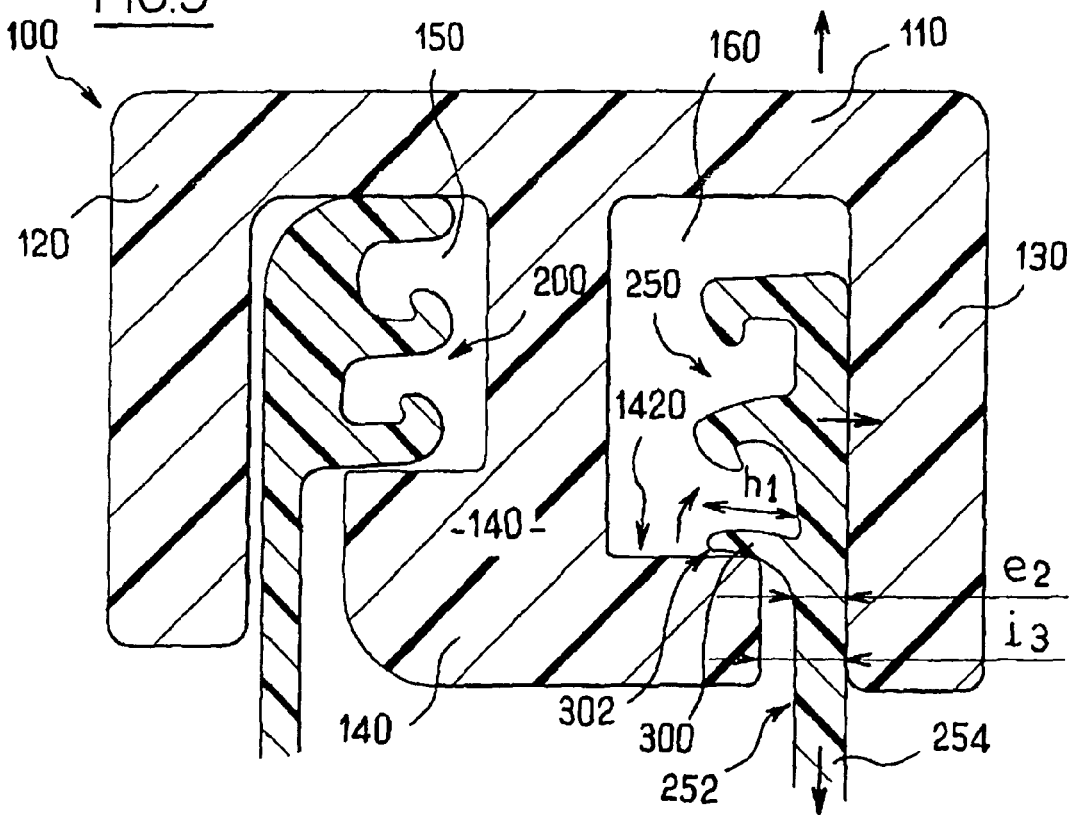

The structure 300 is designed so that when it presses onto the soleplate 142, it tends to flatten element 250 against the associated lateral wall 130 of the slider, as can be seen by examining the comparison in FIGS. 8 and 9.

Thus a large friction is generated between this closure element 250 and the slider 100.

The professional engineer will therefore understand that, in the event of an attempt to pull off of the slider, the friction created prevents the withdrawal of the slider.

More precisely again, in order to achieve the aforementioned effect, preferably:

the rib 300 is at least slightly tapered in the direction of its free end, at rest, the face 302 of the rib 300 facing the soleplate 142 is parallel to the opposite face 1420 of the soleplate 142, or even turned in relation to this face 1420, at least slightly in the direction of its free end, The height hl of the rib 300 is such that the addition of this height hl and the thickness e2 of the backing-strip 254 is greater than the interval i3 which separates the edge of the soleplate 142 and the lateral wall 130. Thus the rib 300 cannot traverse this passage without pressing against the soleplate 142 and thus forcing element 250 against the lateral lateral wall 130.

Of course this present invention is not limited to the particular methods of implementation that have just been described, but extends to any variant that remains within its spirit.

The invention claimed is:

1. A closure assembly that includes two complementary elements (200), (250) that are configured to be successively joined and separated, and a slider (100) that includes a base (110), two lateral walls (120, 130), a low central ridge (140) extending from the base (110) parallel to the two lateral walls (120, 130), wherein the low central ridge (40) comprises a soleplate (142) that extends transversally from a free end of the low central ridge (140), wherein at least one of the two elements (250) has a rib (300) that extends transversally to the at least one of the two elements (250) from an internal face (252) of a backing strip (254) of said at least one of the two elements (250) towards the second of the two elements, wherein said rib (300) and is adjacent to the soleplate (142) and comprises a tapered end configured to press against the soleplate (142) under the effect of a pulling force on the slider, so that when the tapered end of the rib (300) is pressed against the soleplate due to the pulling force on the slider, the backing strip that bears the at least one element (250) which comprises the rib (300) on its inside surface tends to be flattened against the associated lateral wall (130) of the slider and prevents withdrawal of the slider from the at least one of the two complementary elements (250), wherein both of the complementary elements (200) and (250) extend between the base and the soleplate, the rib extends beneath at least one of the two complementary elements (250) between said at least one complementary element (250) and the soleplate (142), and the portion of the soleplate (142) which extends in the area of an upper surface (1420) against which the rib (300) comes into abutment is smaller than the portion of the soleplate which is adjacent to said at least one complementary element (200).

2. An assembly according to claim 1, wherein a height (h1) of said rib (300) is such that the addition of the height (h1) with a thickness (e2) of the backing-strip (254) of the at least one complementary element is greater than an internal passage (i3) which separates an edge of the soleplate (142) and one of said two lateral walls, so that said rib cannot traverse the internal passage without pressing against the soleplate (142) and thus forcing said at least one complementary element (250) to press against the one of said two lateral walls (130).

3. A bag equipped with a closure assembly according to claim 1.

4. A closure assembly comprising:

two complementary elements being capable of successively joined and separated;

a slider that includes a base, two lateral walls, a central ridge extending from the base parallel to the two lateral walls, wherein the central ridge comprises a soleplate that extends transversally from a free end of the central ridge, wherein at least one of the two elements has, on its inside surface, a rib that extends transversally to the at least one of the two elements from an internal face of a backing strip of said at least one of the two elements towards the second of the two elements, wherein said rib is adjacent to the soleplate and comprises a face wherein the whole of the face of the rib presents a deviation in relation to an opposing face of the soleplate that is adapted to press against the soleplate, under the effect of a pulling force on the slider, so that when the face of the rib is pressed against the soleplate due to the pulling force on the slider, the backing strip that bears the at least one element which comprises the rib on its inside surface tends to be flattened against the associated lateral all of the slider and prevents withdrawal of the slider from the complementary elements.

5. A bag equipped with the closure assembly of claim 4.

6. The closure assembly of claim 4 wherein the rib is at least slightly tapered in a direction of a free end of the rib.

7. A bag equipped with the closure assembly of claim 6.

8. The closure assembly of claim 4 wherein a height of the rib is such that the addition of the height with a thickness of a backing strip of the at least one complementary element is greater than an internal passage which separates an edge of the soleplate and the associated one of the lateral walls, so that the rib cannot traverse the internal passage without pressing against the soleplate and thus forcing the element to press against the associated one of the lateral walls.

9. A bag equipped with the closure assembly of claim 8.

10. A closure assembly comprising:

two complementary elements configured to be successively joined and separated;

a slider that includes a base, two lateral walls, a central ridge extending from the base parallel to the two lateral walls, wherein the central ridge comprises a soleplate that extends transversally from a free end of the central ridge, wherein at least one of the two complementary elements has, on its inside surface, a rib that extends transversally to the at least one of the two complementary elements from an internal face of a backing strip of said at least one of the two complementary elements towards the second of the two elements, wherein said rib is adjacent to the soleplate and comprises a face facing the soleplate that extends from an internal face of a backing strip of the one of the two complementary elements to its free end at an angle greater than ninety degrees relative to the internal face, wherein the face is adapted to press against the soleplate under the effect of a pulling force on the slider, so that when the face of the rib is pressed against the soleplate due to the pulling force on the slider, the backing strip that bears the at least one complementary element which comprises the rib on its inside surface tends to be flattened against the associated lateral wall of the slider and prevents withdrawal of the slider from the complementary elements.

11. A bag equipped with the closure assembly of claim 10.

12. The closure assembly of claim 10 wherein the rib is at least slightly tapered in a direction of a free end of the rib.

13. A bag equipped with the closure assembly of claim 12.

14. The closure assembly of claim 12 wherein a height of the structure is such that the addition of the height with a thickness of the backing strip is greater than an internal space which separates an edge of the soleplate and the associated one of the lateral walls, so that the rib cannot traverse the internal passage without pressing against the soleplate and thus forcing the element to press against the associated one of the lateral walls.

15. A bag equipped with the closure assembly of claim 14.

* * * * *

UNITED STATES PATENT AND TRADEMARK OFFICE

CERTIFICATE OF CORRECTION

PATENT NO. : 8,523,438 B2
APPLICATION NO. : 11/399751
DATED : September 3, 2013
INVENTOR(S) : Antony Roger It is certified that error appears in the above-identified patent and that said Letters Patent is hereby corrected as shown below:

In the Claims

Column 4, Claim 4, line 52, please delete “all” and insert --wall--.

Signed and Sealed this
Thirty-first Day of December, 2013

Margaret A. Focarino

Margaret A. Focarino
*Commissioner for Patents of the United States Patent and Trademark Office*